US009775476B2

(12) United States Patent
Jang et al.

(10) Patent No.: US 9,775,476 B2
(45) Date of Patent: Oct. 3, 2017

(54) ROBOT CLEANER AND METHOD FOR CONTROLLING THE SAME

(71) Applicant: LG Electronics Inc., Seoul (KR)

(72) Inventors: Jaewon Jang, Seoul (KR); Sungil Park, Seoul (KR); Hwang Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1050 days.

(21) Appl. No.: 13/924,076

(22) Filed: Jun. 21, 2013

(65) Prior Publication Data

US 2013/0340201 A1 Dec. 26, 2013

(30) Foreign Application Priority Data

Jun. 25, 2012 (KR) ..... 10-2012-0068131

(51) Int. Cl.
*A47L 9/28* (2006.01)
*A47L 9/00* (2006.01)

(52) U.S. Cl.
CPC ..... *A47L 9/009* (2013.01); *A47L 2201/04* (2013.01)

(58) Field of Classification Search
CPC ..... A47L 9/009; A47L 2201/04
IPC ..... A47L 9/28
See application file for complete search history.

(56) References Cited

U.S. PATENT DOCUMENTS 7,673,710 B2 * 3/2010 Lee ..... B25J 5/007 180/8.1
2013/0054026 A1 * 2/2013 Jang ..... G05D 1/0227 700/258

FOREIGN PATENT DOCUMENTS

| | | | |
|---|---|---|---|
| CN | 2723136 | Y | 9/2005 |
| CN | 1974245 | A | 6/2007 |
| CN | 101219682 | A | 7/2008 |
| CN | 102949149 | A | 3/2013 |
| EP | 2433541 | | 3/2012 |
| EP | 2561784 | | 2/2013 |

* cited by examiner

*Primary Examiner* — David Redding
(74) *Attorney, Agent, or Firm* — Dentons US LLP

(57) ABSTRACT

A robot cleaner and a method for controlling the same are disclosed. The robot cleaner includes a body provided with a suction portion and a slope formed to be inclined at a lower end thereof, an auxiliary front wheel disposed at a rear side of the slope, a main wheel disposed at a rear side of the auxiliary front wheel and arranged such that a height of the main wheel is variable with respect to the body, and a driving unit to lower or raise the main wheel with respect to the body, wherein the driving unit lowers the main wheel when the auxiliary front wheel enters a stepped portion. The robot cleaner is capable of climbing up a higher stepped portion than in conventional cases.

10 Claims, 8 Drawing Sheets

ROBOT CLEANER AND METHOD FOR CONTROLLING THE SAME

This application claims the benefit of the Korean Patent Application No. 10-2012-0068131, filed on Jun. 25, 2012, which is hereby incorporated by reference as if fully set forth herein.

BACKGROUND OF THE INVENTION

Field of the Invention

The present invention relates to a robot cleaner and a method for controlling the same, and more particularly to a robot cleaner which is capable of climbing a high stepped portion and a method for controlling the same.

Discussion of the Related Art

In general, a vacuum cleaner is an apparatus which suctions in external air containing foreign substances and then separately collects the foreign substances, by driving an air suction unit provided in the cleaner body to generate air suctioning force.

Vacuum cleaners performing the functions as above are classified into manual vacuum cleaners, which are directly manipulated by a user, and robot cleaners which autonomously perform cleaning operation without manipulation by the user.

The robot cleaner suctions foreign substances such as dust from the floor, autonomously traveling in the area to be cleaned. In other words, the robot cleaner automatically performs cleaning of a certain area. To this end, the robot cleaner is provided with a distance sensor to sense a distance from an obstacle such as furniture, office supplies, or a wall in the area to be cleaned, and left and right wheels for movement of the robot cleaner. Here, the left and right wheels are respectively configured to be rotated by a left wheel motor and a right wheel motor. According to operation of the left wheel motor and the right wheel motor, the robot cleaner autonomously performs indoor cleaning, changing travel direction.

In addition, the robot cleaner is provided, at a lower portion thereof, with a suction nozzle to suction foreign substances from the floor. The suction nozzle includes a nozzle case fixed to the body of the cleaner so as not to be moved, a suction inlet formed on the bottom of the nozzle case to suction foreign substances, and an agitator rotatably arranged at the suction inlet to gather foreign substances such as dust accumulated on the floor to the suction inlet.

In addition to the left and right wheels, which are usually electrically driven, the robot cleaner is further provided with a caster allowing smooth rotating motion of the robot cleaner.

According to the conventional technology described above, when the robot cleaner climbs up the threshold abruptly rising from a lower position to a higher position or enters a carpet, the driving force for the left and right wheels and the frictional force between the left and right wheels and the surface may be insufficient to climb up an encountered stepped portion depending on the height of the stepped portion, and thereby the robot cleaner may fail to climb up the stepped portion.

Particularly, while the robot cleaner needs to be capable of climbing up a stepped portion having a great difference in height between the upper and lower sides of the stepped portion such as the threshold, but the robot cleaner often fails to climb. As a result, the space on the opposite side of the threshold is not cleaned.

SUMMARY OF THE INVENTION

Accordingly, the present invention is directed to a robot cleaner and a method for controlling the same that substantially obviate one or more problems due to limitations and disadvantages of the related art.

An object of the present invention is to provide a robot cleaner which is capable of climbing up a higher stepped portion than in conventional cases and a method for controlling the same.

Another object of the present invention is to provide a robot cleaner which is capable of stably travel in climbing up a stepped portion and a method for controlling the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a robot cleaner includes a body provided with a suction portion and a slope formed to be inclined at a lower end thereof, an auxiliary front wheel disposed at a rear side of the slope, a main wheel disposed at a rear side of the auxiliary front wheel and arranged such that a height of the main wheel is variable with respect to the body, and a driving unit to lower or raise the main wheel with respect to the body, wherein the driving unit lowers the main wheel when the auxiliary front wheel enters a stepped portion.

A height of the auxiliary front wheel with respect to the body may be fixed.

When the main wheel is lowered with respect to the body, an area of the main wheel exposed outside of the body may increase. When the main wheel is raised with respect to the body, the area of the main wheel exposed outside of the body may decrease.

The driving unit may raise the main wheel when the main wheel contacts an upper surface of the stepped portion.

The driving unit may adjust the height of the main wheel to make the body level when the body is inclined by the auxiliary front wheel.

The driving unit may includes an elastic member, one end of the elastic member being connected to one end of a main wheel housing adapted to accommodate the main wheel, and an actuator to pull the elastic member to lower the main wheel with respect to the body.

The actuator may include a rack connected to the other end of the elastic member, a pinion to move the rack forward or backward, and a driving motor to rotate the pinion.

The rack may be engaged with the pinion and moved to cause tensile deformation of the elastic member such that the main wheel is lowered.

In another aspect of the present invention, there is provided a method for controlling a robot cleaner including the steps of determining whether an auxiliary front wheel installed at a body of the robot cleaner enters a stepped portion, lowering a main wheel of the robot cleaner with respect to the body when the auxiliary front wheel enters the stepped portion, determining whether the main wheel enters the stepped portion, and raising the main wheel with respect to the body when the main wheel enters the stepped portion.

During the lowering step, the main wheel may be lowered until the body becomes level.

During the raising step, the main wheel may be raised until the body becomes level.

During the step of determining whether the auxiliary front wheel enters the stepped portion, whether the auxiliary front wheel enters the stepped portion may be determined by determining whether load applied to the main wheel increases.

During the step of determining whether the auxiliary front wheel enters the stepped portion, whether the auxiliary front wheel enters the stepped portion may be determined by determining whether the body is inclined for a predetermined time in a manner that a front side of the body is at a higher position than a rear side of the body.

During the step of determining whether the main wheel enters the stepped portion, whether the main wheel enters the stepped portion may be determined by determining whether load applied to the main wheel is reduced.

During the step of determining whether the main wheel enters the stepped portion, whether the main wheel enters the stepped portion may be determined by determining whether the body is inclined for a predetermined time in a manner that a rear side of the body is at a higher position than a front side of the body.

During the step of determining whether the auxiliary front wheel enters the stepped portion, whether the auxiliary front wheel enters the stepped portion may be determined by determining whether rotational power applied to the main wheel increases. During the step of determining whether the main wheel enters the stepped portion, whether the main wheel enters the stepped portion may be determined by determining whether rotational power applied to the main wheel decreases.

In a further aspect of the present invention, there is provided a robot cleaner including a body provided with a suction portion and a slope formed to be inclined at a lower end thereof, an auxiliary front wheel disposed at a rear side of the slope, a main wheel disposed at a rear side of the auxiliary front wheel and arranged such that a height of the main wheel is variable with respect to the body, a controller to control a driving unit adapted to lower or raise the main wheel with respect to the body, and a sensor to transmit a signal to the controller, wherein the controller lowers or raises the main wheel according to a signal transmitted from the sensor.

The sensor may provide information used to determine inclination of the body.

The sensor may provide information on variation in load applied to the main wheel or variation in rotational power applied to the main wheel.

In a further aspect of the present invention, there is a robot cleaner comprising a body provided with a suction portion, an auxiliary front wheel disposed at the body, a main wheel disposed at a rear side of the auxiliary front wheel and arranged such that a height of the main wheel is variable with respect to the body, and a driving unit to lower or raise the main wheel with respect to the body, wherein the driving unit lowers the main wheel when the auxiliary front wheel enters a stepped portion.

In a further aspect of the present invention, there is provided a robot cleaner including a body provided with a suction portion, an auxiliary front wheel disposed at the body, a main wheel disposed at a rear side of the auxiliary front wheel and arranged such that a height of the main wheel is variable with respect to the body, a controller to control a driving unit adapted to lower or raise the main wheel with respect to the body, and a sensor to transmit a signal to the controller, wherein the controller lowers or raises the main wheel according to a signal transmitted from the sensor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
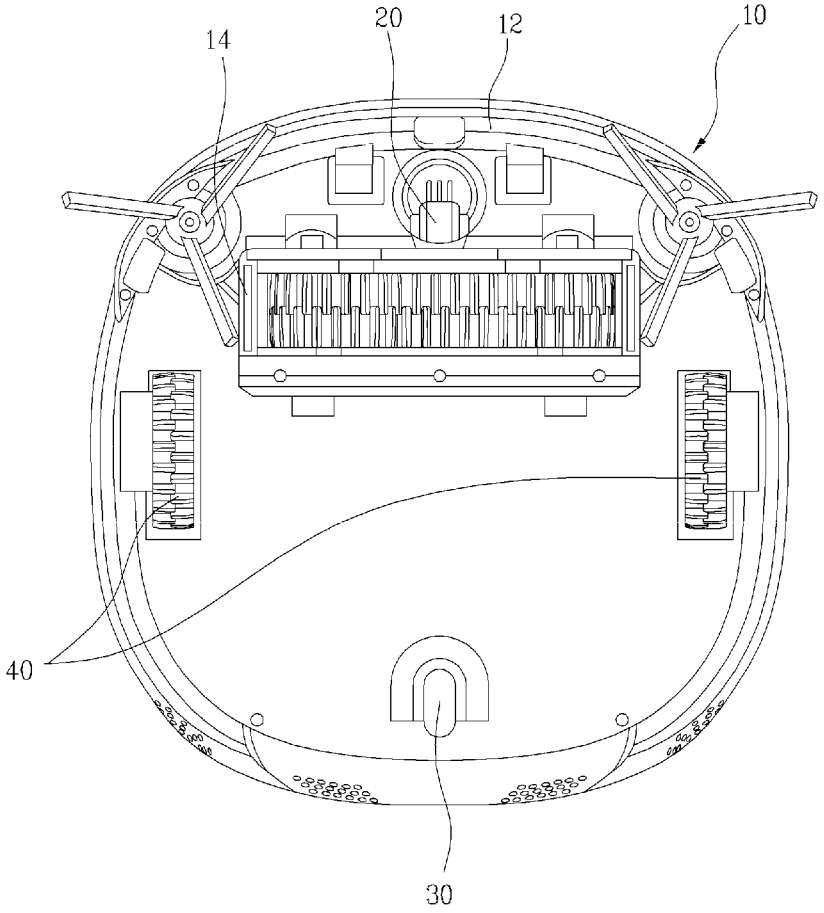
FIG. 1 is a view showing a lower surface of a robot cleaner according to the present invention.

Reference will now be made in detail to the preferred embodiments of the present invention, examples of which are illustrated in the accompanying drawings. Wherever possible, the same reference numbers will be used throughout the drawings to refer to the same or like parts.

The sizes and shapes of constituents shown in the drawings may be exaggerated for clear and easy description. In addition, the terms specifically defined in consideration of the configuration and operation of the present invention may be differently defined according to intention of a user or operator or custom. These terms should be defined based on the entire context of this specification.

FIG. 1 is a view showing a lower surface of a robot cleaner according to the present invention. A description is given below with reference to FIG. 1.

The robot cleaner according to the present invention is provided with a body 10 forming an external appearance of the robot cleaner, a main wheel 40 arranged at the body 10 to allow the body 10 to move back and forth or rotate, and an auxiliary front wheel 20 to support one side of the body 10 and assist the main wheels 40 in rotating the body 10.

Here, the main wheels 40 are independently provided at the left and right sides of the body 10, and thereby each of the main wheels 40 on the left and right sides of the body 10 may be independently driven.

The body 10 is provided with a suction portion 14 which suctions foreign substances and a slope 12 which guides the body 10 when the body 10 climbs up a stepped portion. The slope 12 is a portion formed at a lower end of a front side of the body 10 to be inclined at a predetermined angle.

The suction portion 14 may include an agitator provided at the body 10 to rotate and contact the surface of the floor to be cleaned, and a suction inlet formed at the body 10 to suction in external foreign substances via suction force produced at the inside of the body 10.

The slope 12 is disposed at the very front of the body 10, and the auxiliary front wheel 20 is arranged at the back of the slope 12. The main wheels 40 are disposed at the back of the auxiliary front wheel 20. That is, the slope 12, the auxiliary front wheel 20, and the main wheels 40 may be sequentially positioned.

Meanwhile, an auxiliary rear wheel 30 may be arranged at the back of the main wheels 40 to support the other side of the body 10.

The auxiliary front wheel 20 and the auxiliary rear wheel 30 are arranged to horizontally rotate with respect to the body 10. In addition, the auxiliary front wheel 20 and the auxiliary rear wheel 30 are arranged such that the height thereof does not change with respect to the body 10.

Meanwhile, the main wheels 40 do not horizontally rotate with respect to the body 10. However, the main wheels 40 are configured with two wheels on both sides of the body 10 and allow the body 10 to turn left or right by rotating at different rotational speeds or by rotating in opposite directions.

Particularly, the main wheels 40 are arranged such that the height thereof varies with respect to that of the body 10, unlike the auxiliary front wheel 20. Vertical movement of the main wheels 40 will be described below in detail with reference to the drawings.

Figure 2:
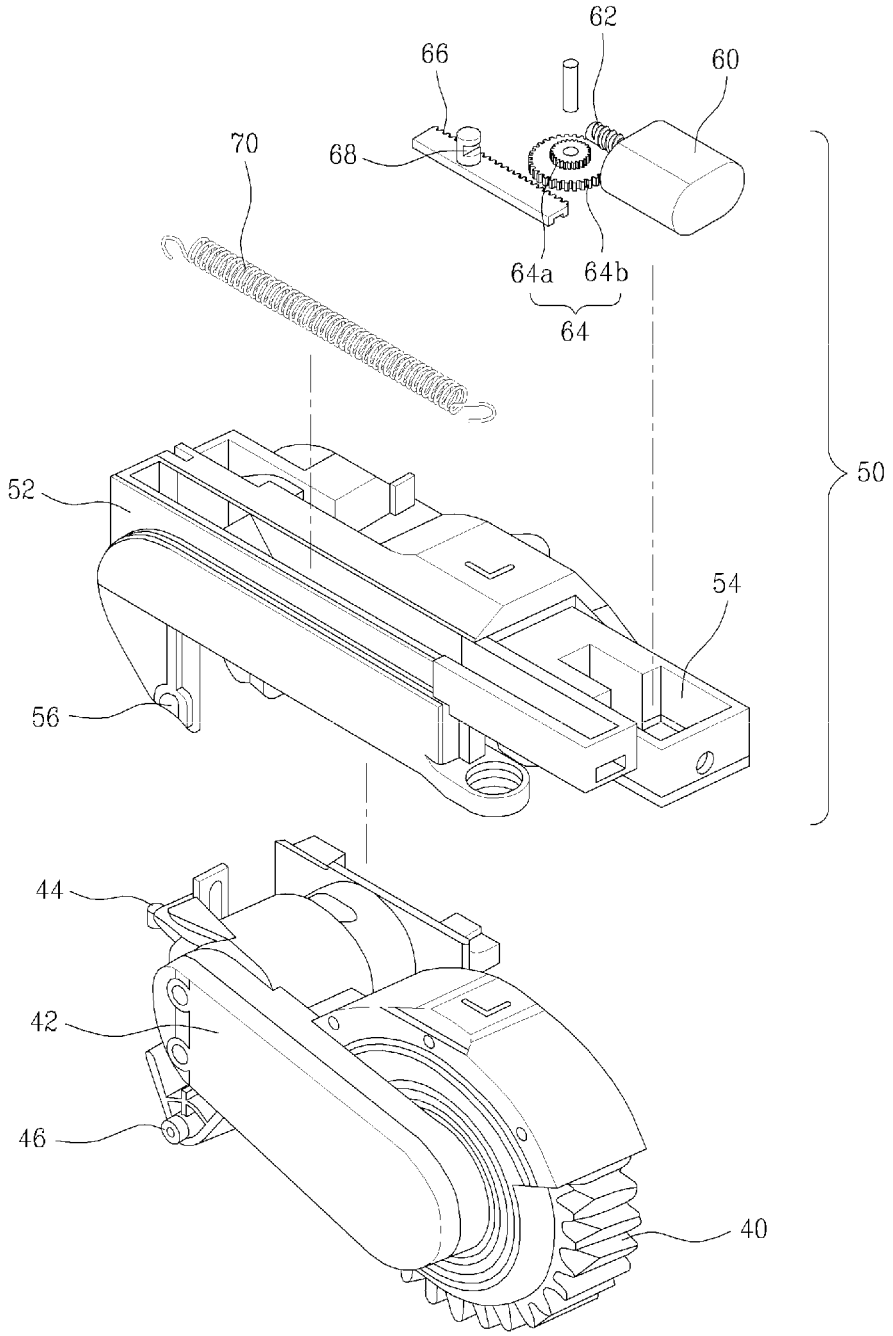
FIG. 2 is an exploded perspective view showing configurations of a driving unit and main wheels according to the present invention.

FIG. 2 is an exploded perspective view showing configurations of a driving unit and main wheels according to the present invention. Hereinafter, a description will be given with reference to FIG. 2.

A description will be given of the main wheels 40 and a driving unit 50 used to vertically move the main wheels 40 with respect to the body 10.

Each of the main wheels 40 is rotatably accommodated and arranged in a main wheel housing 42. The main wheel housing 42 is provided with a rotation shaft 46 arranged to protrude outside. Here, the rotation shaft 46 functions as the center of rotation about which the main wheel housing 42, i.e., a corresponding one of the main wheels 40, rotates with respect to the body 10. Rotation of the entire main wheel housing 42 allows the main wheel 40 to ascend or descend with respect to the body 10.

A first hook 44 is provided at one side of the main wheel housing 42, and thus one end of an elastic member, which will be described later, can be fixed thereto.

The driving unit 50 to vertically move the main wheel 40 includes a driving unit housing 52 in which components related to the driving unit 50 are accommodated. The driving unit housing 52 is fixed to the inside of the body 10.

The driving unit housing 52 is provided with a coupling portion 56 allowing the rotation shaft 46 to be inserted thereinto to be fixed. The rotation shaft 46 is rotatably coupled to the inside of the coupling portion 56.

The driving unit housing 52 is also provided with a motor seating portion 54 at which a driving motor 60 is seated. The motor seating portion 54 is provided with a depression depressed to have a predetermined depth to allow the driving motor 60 to be accommodated and buried in the motor seating portion 54.

The driving unit 50 includes an elastic member 70 coupled to one end of the main wheel housing 42, i.e., to the first hook 44. The driving unit 50 also includes an actuator to pull the elastic member 70 to lower the main wheel 40 with respect to the body 10.

The actuator includes a rack 66 connected to the other end of the elastic member 70, a pinion 64 to move the rack 66 forward or backward, and a driving motor 60 to rotate the pinion 64.

The rack 66 includes a second hook 68 to which the other end of the elastic member 70 is fixed. That is, both ends of the elastic member 70 may be fixed by the first hook 44 and the second hook 68.

Here, the elastic member 70 may be an extension spring adapted to extend when external force is applied thereto and to return to original shape when the external force is removed.

Meanwhile, a worm gear 62 may be installed at the rotating shaft of the driving motor 60. Since the worm gear 62 is used, a separate stopper is not necessary to keep the elastic member 70 in an extended or unextended state.

In addition, the pinion 64 includes a worm wheel gear 64*a* to be engaged with the worm gear 62 and a pinion gear 64*b* provided at a lower end of the worm wheel gear 64*a*. Since the pinion gear 64*b* is engaged with the teeth of the rack 66, rotation of the pinion gear 64*b* allows forward or backward movement of the rack 66.

Meanwhile, when the worm wheel gear 64*a* is rotated by rotational force of the worm gear 62 transferred thereto, the pinion gear 64*b* is rotated as well. Thereby, the pinion 64 may transfer the rotational force of the driving motor 60 to the rack 66.

The rack 66 is accommodated in a guide groove formed in the driving unit housing 52 and is guided to move along the longitudinal direction of the guide groove.

That is, the rack 66, the elastic member 70, the driving motor 60 and the pinion 64 may be fixed to the body 10, while being accommodated in the driving unit housing 52.

Figure 3:
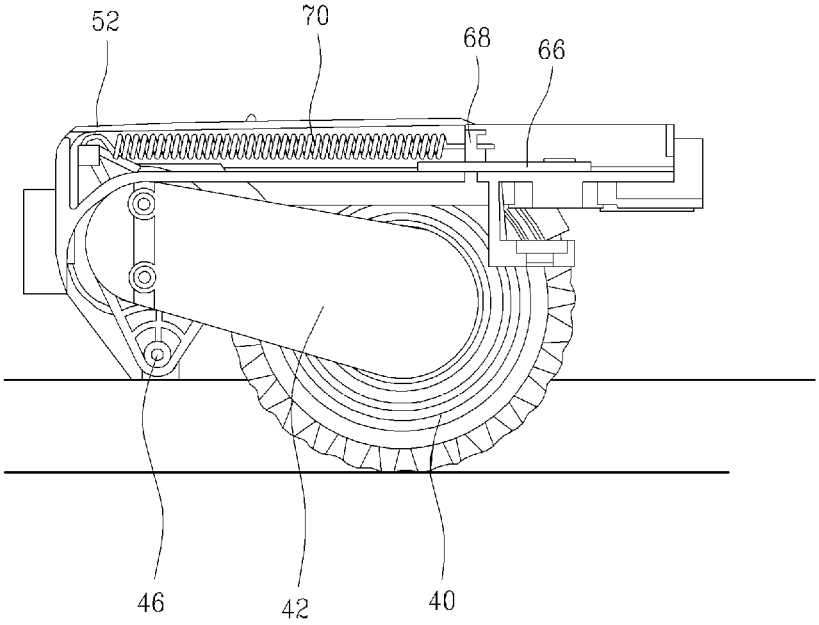
FIG. 3 is a view showing the main wheel in a raised position.
Figure 4:
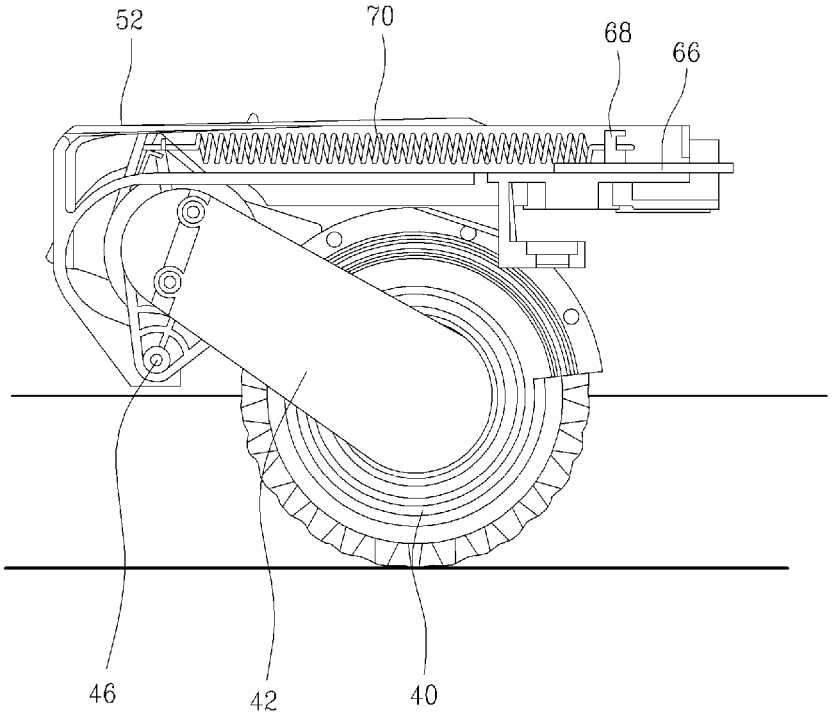
FIG. 4 is a view showing the main wheel in a lowered position.

FIG. 3 is a view showing the main wheel in a raised position, and FIG. 4 is a view showing the main wheel in a lowered position. Hereinafter, a description will be given with reference to FIGS. 3 and 4.

When the main wheel 40 is raised as exemplarily shown in FIG. 3, the rack 66 is positioned relatively forward.

Accordingly, the elastic member 70 is extended to a relatively short distance, and thus the main wheel 40 is disposed close to the body 10.

On the other hand, when the rack 66 is moved backward as shown in FIG. 4, the elastic member 70 is extended by a relatively long distance. That is, as one end of the elastic member 70 is pulled by the rack 66, the one end of the elastic member 70 is moved backward, and the main wheel 40 is lowered by the elastic member 70. At this time, the main wheel housing 42 rotates counterclockwise about the rotation shaft 46, and thereby the main wheel 40 is further lowered than when it is arranged as in FIG. 3.

Meanwhile, the position of the main wheel 40 is fixed by the elastic member 70. Thereby, when the main wheel 40 moves over an uneven surface, part of shock to the wheel 40 may be absorbed by the elastic member 70. Accordingly, when the robot cleaner passes the uneven surface, the amount of shock exerted on the body 10 by the uneven surface may be reduced and stable movement of the robot cleaner may be ensured. Thereby, travel performance of the robot cleaner may be improved.

Figure 5:
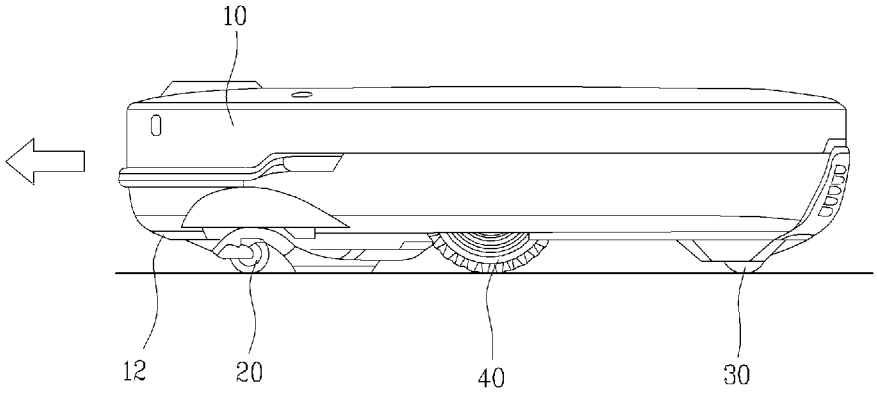
FIG. 5 is a view showing the robot cleaner passing a level surface.

FIG. 5 is a view showing the robot cleaner passing a level surface. Hereinafter, a description will be given with reference to FIG. 5.

The lower end of the foremost part of the body 10 is provided with a slope 12 formed to be inclined. The slope 12 is arranged at a predetermined angle such that, when the robot cleaner encounters a stepped portion during forward traveling, one side of the slope 12 may ride over the stepped portion.

As exemplarily shown in FIG. 5, in the case that the robot cleaner passes a level surface, i.e., a surface which does not have a stepped portion, the auxiliary front wheel 20, the auxiliary rear wheel 30 and the main wheels 40 all rotate, contacting the floor surface together.

In this case, with the main wheel 40 kept raised, the surface contacting the auxiliary front wheel 20 is level with the surface contacting the auxiliary rear wheel 30.

When the robot cleaner passes over a level surface, the body 10 is moved without being inclined to the front side or rear side of the body 10.

While the auxiliary front wheel 20 and the auxiliary rear wheel 30 do not receive separate driving force, the main wheels 40 receive rotational force from a motor to move the body 10.

Figure 6:
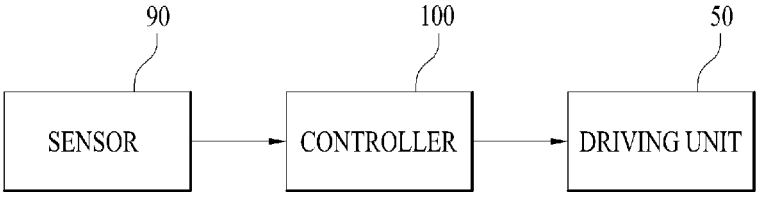
FIG. 6 is a block diagram according to the present invention.

FIG. 6 is a block diagram according to the present invention. Hereinafter, a description will be given with reference to FIG. 6.

The robot cleaner is provided with various sensors 90.

The sensors 90 may include an obstacle detection sensor to sense an obstacle present at the front side or rear side of the robot cleaner, a sensor to determine if the robot cleaner is inclined, a sensor to sense variation of load applied to the main wheel 40, and a sensor to sense change in rotational force applied to or used in the main wheel 40.

The sensors 90 may provide information used to determine if the body is inclined. In this case, when the body is not disposed parallel with a level surface but is inclined to one side, the sensors 90 may obtain information on an extent of inclination of the body.

In addition, the sensors 90 may provide information on variation of load applied to the main wheel 40 or rotational force applied to the main wheel 40. In this case, the sensors 90 may be disposed adjacent to main wheel to measure load applied to the main wheel 40 or the amount of current supplied to the motor supplying rotational force to the main wheel 40 to obtain the information.

The information obtained by the sensors 90 is transmitted to the controller 100. Then, the controller 100 may control movement and suction force of the robot cleaner according to signals transmitted from the sensors 90.

Particularly, the controller 100 may control the driving unit 50 according to signals transmitted from the sensors 90. That is, when the controller 100 determines that the robot cleaner needs to climb up a stepped portion, it may drive the driving unit 50 to lower the main wheel 40. On the other hand, when the controller 100 determines that the robot cleaner has climbed up the stepped portion, it may drive the driving unit 50 to raise the main wheel 40 to return the main wheel 40 to an original position thereof.

Figure 7:
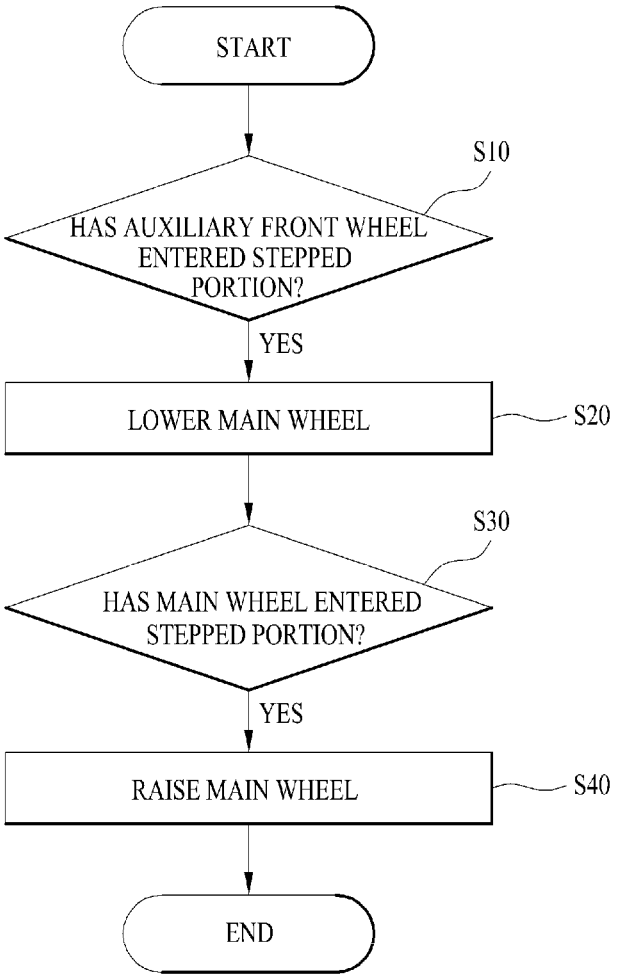
FIG. 7 is a control flowchart according to the present invention.
Figure 8:
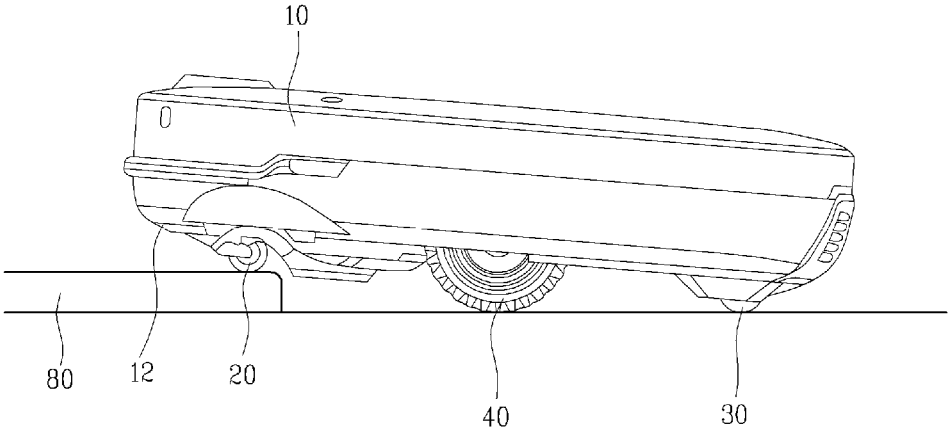
FIGS. 8 to 10 are views illustrating the process of the robot cleaner passing over a stepped portion.
Figure 9:
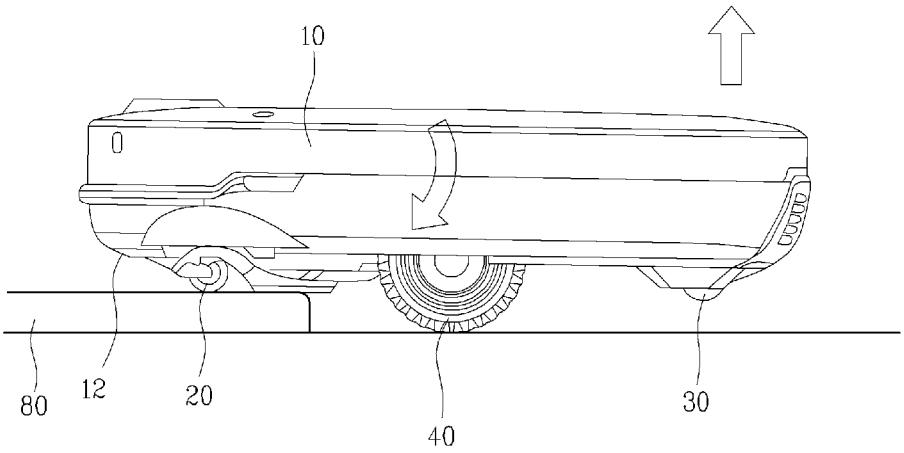
Figure 10:
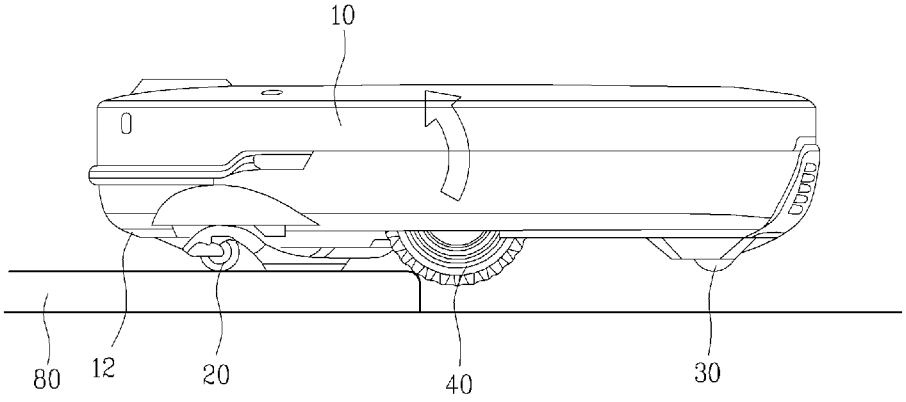

FIG. 7 is a control flowchart according to the present invention, and FIGS. 8 to 10 are views illustrating the process of the robot cleaner passing over a stepped portion. Hereinafter, movement of the robot cleaner will be described with reference to FIGS. 7 to 10.

The robot cleaner usually travels on a level surface as exemplarily shown in FIG. 5.

The robot cleaner traveling on a level surface may move to a stepped portion as exemplarily shown in FIG. 8. The sensor of the robot cleaner to sense an obstacle positioned in front of or behind the robot cleaner checks if the stepped portion 80 has a height allowing the robot cleaner to cross over the stepped portion 80. If it is determined that the robot cleaner can move over the stepped portion 80, the body 10 moves forward to the stepped portion 80.

Just before the body 10 enters the stepped portion 80, the slope 12 may contact the stepped portion 80. Subsequently, with rotation of the main wheel 40, the slope 12 is raised along the front surface of the stepped portion 80, and is caused to move over the stepped portion 80 by inclination of the slope 12 and the driving power of the body 10 from rotation of the main wheel 40.

As the main wheel 40 continuously rotates, the slope 12 in contact with the stepped portion 80 is separated from the stepped portion 80. Subsequently, the auxiliary front wheel 20 comes into contact with the stepped portion 80, while the main wheel 40 continues rotating.

Then, the controller 100 determines if the auxiliary front wheel 20 has entered the stepped portion 80 according to information received from the sensors 90 (S10).

For example, whether the auxiliary front wheel 20 has entered the stepped portion 80 may be determined by occurrence of inclination of the body 10 with the front side thereof positioned higher than the rear side thereof for a predetermined time. Once the auxiliary front wheel 20 moves to the top of the stepped portion 80, the front side of the stepped portion 80 remains disposed higher than the rear side of the stepped portion 80 for a predetermined time. In the case that the body 10 passes over an uneven portion having a height less than the height of a usual stepped portion 80, inclination of the body 10 is sensed for a time shorter than the predetermined time, and the inclination is removed in a short time. Accordingly, the body 10 may remain in the horizontal position. In the case of encountering such an uneven portion, the robot cleaner is allowed to travel according to the rotational force of the main wheel 40, and therefore the main wheel 40 is not lowered. Here, the predetermined time may be set to a proper time determined by a manufacturer of the robot cleaner.

Further, whether the auxiliary front wheel 20 has entered the stepped portion 80 may be determined by increase in load applied to the main wheels 40. When the auxiliary front wheel 20 is moved to the top of the stepped portion 80, the front side of the body 10 is higher than the rear side thereof, and therefore a smaller portion of the weight of the body 10 is supported by the auxiliary front wheel 20. On the other hand, a larger portion of the weight of the body 10 is supported by the main wheels 40. In addition, as the auxiliary front wheel 20 is moved to the top of the stepped portion 80, greater rotational power needs to be transferred to the main wheels 40 than when on a level surface to maintain the same traveling speed as the speed at which the body 10 travels on the level surface. Accordingly, by combining various types of information, whether the auxiliary front wheel 20 has entered the stepped portion 80 may be determined.

Meanwhile, entry of the auxiliary front wheel 20 onto the stepped portion 80 may mean that the auxiliary front wheel 20 contacts the upper surface of the stepped portion 80. Once the auxiliary front wheel 20 contacts the upper surface of the stepped portion 80, the auxiliary front wheel 20 is not raised any more, but is kept at a constant level.

When it is determined that the auxiliary front wheel 20 has entered the stepped portion 80, the main wheel is lowered as exemplarily shown in FIG. 9 (S20).

At this time, the driving motor 60 is driven to lower the main wheel 40. Rotation of the driving motor 60 is transferred to the worm gear 62, and thereby the worm gear 62, engaged with the worm wheel gear 64*a*, rotates.

Since the worm wheel gear 64*a* rotates together with the pinion gear 64*b*, the pinion 64 may move the rack 66 backward.

Since the rack 66 is moved backward from the original position thereof, the elastic member 70 is extended. By tension of the elastic member 70, which resists the force extending the elastic member, the main wheel housing 42 may rotate about the rotation shaft 46, allowing the main wheels 40 to be lowered.

At this time, the main wheel 40 may be lowered until the body 10 is horizontally positioned. In the case that the main wheel 40 is lowered, the sensors 90 may allow the driving motor 60 to rotate until it is determined that the body 10 is no longer inclined, i.e., until the body 10 is level, and may stop rotation of the driving motor 60 when the body 10 is level.

As the main wheel 40 is lowered, the body 10 is raised with respect to the main wheel 40, and thereby the body 10 may become level.

Meanwhile, the main wheel 40 vertically moves and therefore the robot cleaner according to the illustrated embodiment may climb up a higher stepped portion than in conventional cases.

In conventional cases, heavy load is applied to the main wheels 40 from the moment at which the slope 12 starts to go up the stepped portion 80 until the main wheels 40 are about to climb the stepped portion 80. Supporting this heavy load, the main wheels 40 may be raised by friction between the main wheels 40 and the floor surface and larger rotational power applied to the main wheels 40. However, the friction and the rotational power applied to the main wheels 40 do not increase beyond specific values. That is, the height of the stepped portion 80 that the main wheels are allowed to climb by friction and rotational power is limited.

Further, as the body 10 keeps moving forward to the stepped portion 80 with the auxiliary front wheel 20 raised to the top of the stepped portion 80 as exemplarily shown in FIG. 8, the front side of the body 10 is increasingly raised with respect to the rear side thereof, and thus the inclination angle of the body 10 increases. When the auxiliary rear wheel 30 comes into contact with the floor surface in this situation, friction between the main wheels 40 and the floor surface will inevitably be reduced. Therefore, even if the rotational power of the main wheels 40 is large, the body 10 may not climb up the stepped portion 80 anymore.

Particularly, when forward movement of the body 10 to the stepped portion 80 results in a situation in which the body 10 is supported by the auxiliary rear wheel 30 and the auxiliary front wheel 20, i.e., the main wheels 40 do not contact the floor surface, the robot cleaner may not move either forward or backward. This is because forward or backward movement of the robot cleaner is caused not by the auxiliary front wheel 20 and the auxiliary rear wheel 30 but by driving force from the main wheels 40.

To address such situation, the main wheels 40 according to the illustrated embodiment are allowed to vertically move, and thus the main wheels 40 may remain in contact with the floor surface. On the other hand, when the main wheels 40 are lowered as exemplarily shown in FIG. 9, the auxiliary rear wheel 30 in contact with the floor surface is separated from the floor surface.

Next, whether the main wheels 40 have entered the stepped portion 80 is determined (S30).

For example, whether the main wheels 40 have entered the stepped portion 80 may be determined by reduction in load applied to the main wheels 40. Once the main wheels 40 enters the stepped portion 80, the portion of the weight of the body 10 applied to the main wheels 40 is reduced compared to the portion applied to the main wheels 40 positioned at the lower side of the stepped portion 80. Accordingly, the body 10 may be moved even by a rotational force of the main wheels 40 less than before the main wheels 40 enter the stepped portion 80.

Further, whether the main wheels 40 have entered the stepped portion 80 may be determined by determining whether the rear side of the body 10 remains at a higher position than the front side for a predetermined time. Before the main wheels 40 enter the stepped portion 80, the main wheels are at lowered positions, and the body 10 is raised with respect to the main wheels 40.

When the main wheel 40 enters the stepped portion 80 under this condition, the main wheel 40 and the auxiliary front wheel 20 both climb up the stepped portion 80, and therefore the front side of the body 10 is lowered with respect to the rear side thereof.

Here, the predetermined time may be a time value which may be set by a manufacturer of the robot cleaner.

Once the main wheels 40 enter the stepped portion 80, the main wheels 40 are raised as exemplarily shown in FIG. 10 (S40).

The main wheels 40 may be raised until the body 10 become level.

As described above, the driving unit 50 may adjust the height of the main wheel 40 to make the body 10 level when the body 10 is inclined by the auxiliary front wheel 20. Accordingly, when the robot cleaner passes over the stepped portion 80, constituents included in the body 10 may be prevented from leaning to one side, and thus the robot cleaner is allowed to stably travel.

As can be seen from comparison between FIGS. 5 and 9, descent of the main wheel 40 with respect to the body 10 may increase the area of the main wheel 40 exposed outside of the body 10, while ascent of the main wheel 40 with respect to the body 10 may reduce the area of the main wheel 40 exposed outside of the body 10.

As is apparent from the above description, the present invention has effects as follows.

A robot cleaner according to an embodiment of the present invention is capable of climbing up a higher stepped portion than in conventional cases. Accordingly, inconvenience caused by failing to ride over a high threshold and clean the space arranged on the opposite side of the threshold may be eliminated.

According to the present invention, when the robot cleanser travels over a high stepped portion, the horizontal position of the robot cleaner is stabilized. Therefore, stable travel of the robot cleaner may be implemented.

In addition, according to the present invention, when the robot cleaner passes through an uneven surface, shock from the surface may be absorbed by an elastic member of the robot cleaner. Therefore, shaking of the robot cleaner may be reduced during travel.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A robot cleaner comprising:

a body provided with a suction portion;

an auxiliary front wheel disposed at the body;

a main wheel disposed at a rear side of the auxiliary front wheel and arranged such that a height of the main wheel is variable with respect to the body; and a driving unit to lower or raise the main wheel with respect to the body, wherein the driving unit lowers the main wheel when the auxiliary front wheel enters a stepped portion, wherein the driving unit raises the main wheel when the main wheel contacts an upper surface of the stepped portion.

2. The robot cleaner according to claim 1, wherein a height of the auxiliary front wheel with respect to the body is fixed.

3. The robot cleaner according to claim 1, wherein:

when the main wheel is lowered with respect to the body, an area of the main wheel exposed outside of the body increases; and when the main wheel is raised with respect to the body, the area of the main wheel exposed outside of the body decreases.

4. The robot cleaner according to claim 1, wherein the driving unit adjusts the height of the main wheel to make the body level when the body is inclined by the auxiliary front wheel.

5. A robot cleaner comprising:

a body provided with a suction portion;

an auxiliary front wheel disposed at the body;

a main wheel disposed at a rear side of the auxiliary front wheel and arranged such that a height of the main wheel is variable with respect to the body; and a driving unit to lower or raise the main wheel with respect to the body, wherein the driving unit lowers the main wheel when the auxiliary front wheel enters a stepped portion, wherein the driving unit comprises:

an elastic member, one end of the elastic member being connected to one end of a main wheel housing adapted to accommodate the main wheel; and an actuator to pull the elastic member to lower the main wheel with respect to the body.

6. The robot cleaner according to claim 5, wherein the actuator comprises:

a rack connected to the other end of the elastic member;

a pinion to move the rack forward or backward; and a driving motor to rotate the pinion.

7. The robot cleaner according to claim 6, wherein the rack is engaged with the pinion and moved to cause tensile deformation of the elastic member such that the main wheel is lowered.

8. A robot cleaner comprising:

a body provided with a suction portion;

an auxiliary front wheel disposed at the body;

a main wheel disposed at a rear side of the auxiliary front wheel and arranged such that a height of the main wheel is variable with respect to the body;

a controller to control a driving unit adapted to lower or raise the main wheel with respect to the body; and a sensor to transmit a signal to the controller;

wherein the controller lowers or raises the main wheel according to a signal transmitted from the sensor.

9. The robot cleaner according to claim 8, wherein the sensor provides information used to determine inclination of the body.

10. The robot cleaner according to claim 8, wherein the sensor provides information on variation in load applied to the main wheel or variation in rotational power applied to the main wheel.

* * * * *